US006401786B1

(12) United States Patent
Tedeschi et al.

(10) Patent No.: US 6,401,786 B1
(45) Date of Patent: Jun. 11, 2002

(54) DEVICE FOR MAKING STRETCH CUSHION STRAP ASSEMBLIES

(75) Inventors: Anthony J. Tedeschi, Ridgewood, NJ (US); P. Benjamin Paschal, Newnan, GA (US); Joseph M. Petrovich, Vernon, NJ (US); Billy Poindexter, II, Newnan, GA (US); Gloria Falla, Demarest, NJ (US)

(73) Assignee: Playtex Apparel, Inc., Stamford, CT (US)

( * ) Notice: Subject to any disclaimer, the term of this patent is extended or adjusted under 35 U.S.C. 154(b) by 0 days.

(21) Appl. No.: 09/268,800

(22) Filed: Mar. 16, 1999

Related U.S. Application Data

(62) Division of application No. 08/904,518, filed on Aug. 1, 1997, now Pat. No. 5,984,762, which is a continuation-in-part of application No. 08/792,059, filed on Feb. 3, 1997, now abandoned, which is a continuation of application No. 08/553,853, filed on Nov. 6, 1995, now abandoned, which is a continuation of application No. 08/162,537, filed on Dec. 3, 1993, now Pat. No. 5,507,681.

(51) Int. Cl.[7] ..... B32B 31/00

(52) U.S. Cl. ..... 156/515; 156/495; 156/516; 156/522; 156/530; 156/552; 156/583.1; 156/251; 156/265; 156/270; 156/301; 156/302; 2/459; 2/460; 2/468; 450/86; 450/92; 24/1; 226/30

(58) Field of Search ..... 156/515, 530, 156/251, 495, 269, 270, 522, 552, 301, 302, 265, 516, 583.1; 450/92, 86; 2/268, 459, 460; 226/30; 24/1

(56) References Cited

U.S. PATENT DOCUMENTS

| | | | | | |
|---|---|---|---|---|---|
| 2,519,330 | A | * | 8/1950 | Evans et al. | 156/88 |
| 3,667,664 | A | * | 6/1972 | Schroeder | 226/30 |
| 4,045,271 | A | * | 8/1977 | Clark et al. | 156/366 |
| 4,384,908 | A | * | 5/1983 | Kleist | 156/88 |
| 4,525,231 | A | * | 6/1985 | Wnuk | 156/185 |
| 4,529,463 | A | * | 7/1985 | Bartolini | 156/226 |
| 4,592,118 | A | * | 6/1986 | DeWoskin | 24/444 |

* cited by examiner

*Primary Examiner*—Linda Gray
(74) *Attorney, Agent, or Firm*—Ohlandt, Greeley, Ruggiero & Perle, LLP

(57) ABSTRACT

A laminated stretch cushion strap assembly having a stretchable cover, a stretchable cushion filler and a stretchable bottom or bottom fabric. The cover includes a stretchable top fabric, a first adhesive web layer positioned on one side of the top fabric and a stretchable base layer positioned on the first adhesive layer on a side opposite that of the top fabric. The stretchable bottom fabric forms with the cover an enclosure. The stretchable cushion filler is adapted to be completely enclosed within the enclosure. The stretchable cushion filler has a first cushion layer, and adhesive for securing during lamination the cover to the stretchable cushion filler, and the cushion filler to the stretchable bottom fabric. The adhesive is a second adhesive web layer positioned between the stretchable base layer and the first cushion layer to secure the cushion filler to the cover, and a third adhesive web layer positioned on the first cushion layer to secure the bottom fabric to the cushion filler. The components of the cushion strap assembly are laminated together completely by heat and adhesive. The present invention also provides a method and device for making this cushion strap.

4 Claims, 4 Drawing Sheets

DEVICE FOR MAKING STRETCH CUSHION STRAP ASSEMBLIES

This is a division of application Ser. No. 08/904,518 that was filed on Aug. 1, 1997 and issued as U.S. Pat. No. 5,984,762 on Nov. 16, 1999, which is continuation-in-part of application Ser. No. 08/792,059 that was filed on Feb. 3, 1997 and is now abandoned, which is a continuation of application Ser. No. 08/553,853 that was filed on Nov. 6, 1995 and is now abandoned, which is a continuation of application Ser. No. 08/162,537 that was filed on Dec. 3, 1993 and issued as U.S. Pat. No. 5,507,681 on Apr. 16, 1996.

BACKGROUND OF THE INVENTION

1. Field of the Invention

The present invention relates generally to a strap assembly and, more particularly, to a stretch cushion strap assembly for use in a shoulder strap. This stretch cushion strap assembly provides relief from the normal discomfort associated with shoulder straps, while maintaining the desired aesthetic appearance even after repeated machine washings. The strap assembly is uniquely designed to move with the wearer to support her. In addition, the present invention provides a method and device for making such a stretch cushion strap assembly. A primary use of this stretch cushion strap assembly is in shoulder straps of a brassiere.

A well known problem associated with brassiere shoulder straps is the discomfort caused by the strap on the shoulder of the wearer. Specifically, each brassiere strap will normally cause either a depression or irritation in the shoulder and may even interfere with arterial or venous drainage. Numerous attempts have been made to relieve this discomfort. Some attempts have included use of shoulder pads of cotton or foam rubber that are interposed between the strap and the wearer's shoulder or releasably attachable to the strap.

Significantly, such pads have proven to be bulky and unsightly. Also, there are inconveniences attendant with such attachments since such pads will need to be removed, and subsequently reattached, each time the brassiere is washed.

Some brassiere straps have attempted to incorporate a pad structure in the strap itself. Such brassiere straps may have achieved a modicum of success in relieving discomfort. However, such brassieres have. limited user life since they fail to maintain their desired appearance after several machine washings, apparently due to the effect cleaning detergents have on the construction and materials of the brassiere strap. Particularly well known is that pads and straps made of foam have been found to yellow after a few washings. It is also common that brassieres that have incorporated a pad therein have a knotted or bumpy appearance after repeated machine washings. Moreover, none of these straps provided the comfort of a stretch shoulder strap, that can stretch longitudinally to move with the wearer.

Other attempts to relieve discomfort, yet provide a modicum of pleasing appearance, have included widening the shoulder strap in order to better distribute the weight in the shoulder area. Still other attempts have been to incorporate elastic bands with a padded cover in the strap to provide more flexibility and thus attempt to better distribute the pressure in the shoulder area.

These attempts have, heretofore, failed to achieve the desired results, namely relief of the discomfort in the shoulder area, with a smooth attractive appearance that is maintained even after repeated wear and machine washing, combined with flexibility and give to allow the strap to move with the wearer. Thus, long wear life and comfort have evaded prior art shoulder straps.

U.S. Pat. No. 5,507,681 to Smith et al., assigned in common with the present invention, discloses a Cushion Strap Assembly and Method of Making Same that addresses most of these problems. The unique structure and components of the claimed cushion strap provide a sleek strap that is comfortable and durable.

The present invention relates to an improved, stretchable cushion strap that provides additional advantages above and beyond those disclosed in the Smith et al. patent.

2. Description of the Prior Art

A number of prior art patents illustrate the use of a pad that is secured to a shoulder strap. For example, U.S. Pat. No. 4,845,785 to F. Allen, titled: Hinged Shoulder Pad, is directed to a shoulder pad that has a laminated unitary structure arrangement comprising a plurality of juxtaposed panels overlying one another, and hinge means integrally connecting adjacent panels to enable relative flexible pivotal movement therebetween.

U.S. Pat. No. 4,795,399 to W. W. Davis, titled: Brassiere Shoulder Strap Bearing Pad, is directed to a bearing pad for brassiere shoulder straps that is intended to alleviate irritating indentations to the skin of the wearer. The pad comprises a-composite elongated member having two plies of material fastened together, one of said plies defining an upper ply adapted to engage one shoulder strap to act as a bearing surface, and the other ply defining a lower ply for contacting the skin of the wearer. The upper ply is a stiff, high density, polyethylene synthetic plastic material, and the lower ply is a low density, soft, non-woven cushion material comprising polyester fibers. The upper ply has attaching means that entrap the brassiere strap while permitting the pad to adjustably slide along the strap for positioning on the shoulder of the wearer.

U.S. Pat. No. 2,523,720 to W. Riedler, et al., titled: Shoulder Pad, provides a cover having superposed thereon plies that are placed one upon another. The plies are preferably formed of a relatively loose mass of fibers, the surface of which is coated with a thermosetting plastic and adhesive. See also, U.S. Pat. No. 2,485,720 to G. B. Elliott, et al., titled: Pad For Shoulder Straps, provides a shoulder pad having an upper fabric layer adhesively secured to a lower fabric layer, and U.S. Pat. No. 2,511,483 to B. Skirow, et al., titled: Shoulder Pad For Garments And The Like, that includes a plurality of superimposed layers of loosely felted fibrous material, and U.S. Pat. No. 2,616,093 to J. A. Talalay, titled: Apparel Pad, that shows a plurality of layers of woven fabric separated apart by layers of rubber. Also, U.S. Pat. No. 3,369,547 to G. H. Sack, et al., titled: Extensible Sheet Material, that provides an intermediate layer of non-elastic fibers contained between a top covering layer and a bottom covering layer of polyurethane sponge that are bonded together by a continuous heat seal along the edges.

U.S. Pat. No. 4,945,576 to A. R. Melton, titled: Shoulder Pad and Brassiere Strap Cushion Apparatus, is directed to a shoulder pad and strap cushion that includes an outer layer, an inner layer, cushion means disposed between the outer and inner layers, and fastening means secured to the inner layer means for securing the bra strap between the inner and outer layer means of the pad.

Other prior art patents provide for the padded material as an insert or an integral part of the brassiere shoulder strap. For example, U.S. Pat. No. 2,402,292 to B. Nichols, titled: Shoulder Pad, discloses a pad or bat of soft material that gives the shoulder pad substantial thickness. The bat is held in place by the arrangement of an upper fabric layer and a lower fabric layer that form a pocket. In addition, the pad is substantially wider at the mid-portion than at the area at which the straps are connected.

U.S. Pat. No. 4,100,924 to F. M. Rosenberg, titled: Shoulder Strap, is directed to a shoulder strap that includes a flexible elongated main strap portion, a widened flexible intermediate portion, a first single pocket extending diagonally to the length of the strap across the intermediate portion, a second single pocket having a width less than the width of the first pocket and extending at an angle with respect to the length of the strap across the intermediate portion, and a pair of stays each disposed within a pocket. The stays substantially bridge the scapula and clavicle of the person's shoulder without interfering with arterial or venous drainage of the shoulder.

U.S. Pat. No. 3,025,859 to F. M. Rosenberg, titled: Shoulder Load Carrying Strap, provides a strap that comprises a relatively wide intermediate supporting portion that is integrally connected to the respective shoulder strap elements. The strap comprises a flexible outer fabric layer and a relatively soft yieldable cushioning material or flexible inner layer that is adapted to engage the wearer's body.

Still other prior art patents includes an elastic member, or form a laminate that include a padded material. For example, U.S. Pat. No. 4,638,513 to A. J. Woods, titled: Laterally Stabilized Bra Strap, is directed to a strap that has elastic ribbon means adapted. to stretch in at least the longitudinal direction, padding means enclosing the elastic ribbon means, smooth-faced material means enclosing the padding means, and stitching means attaching the ribbon means, the padding means, and the material means along each longitudinal edge of the strap.

U.S. Pat. No. 4,795,400 to B. Greenberg, titled: Brassiere Strap, provides a brassiere strap that includes a laminate band consisting of a foam laminate located between an outer laminae, an inner laminae formed of at least a ply of fabric, and first and second cold adhesive layers sealing the foam laminae to the outer and inner laminae. The combined laminate and elastic bands provide sufficient rigidity to prevent substantial bowing in response to longitudinal stresses in the brassiere strap, yet sufficient flexibility to permit the strap to conform to the configuration of the shoulder of the brassiere.

U.S. Pat. No. 3,616,148 to I. Edelman, titled: Laminated Shoulder Strap, is laminated from a nylon tricot fabric tape, a cotton fabric tape, and a thermoplastic web formed of a material capable of bonding together tapes. See also U.S. Pat. No. 3,256,131 to A. G. Koch, et al., titled: Embossed Laminate And Method Of. Making Same, which provides a cover material placed over foam that in turn is placed over backing material, such as nylon fabric, to form a laminate; and Japanese reference '976 provides a core material of urethane foam, adhesive and a cover, that are heated and pressed together.

U.S. Pat. No. 5,165,113 to A. Hyams, et al., titled:. Padded Straps For Garments and Method of Making Same, is directed to a padded strap for a garment that includes a core of resilient material having a pad portion of a first thickness and density, and a compressed base portion surrounding the pad portion of a second lesser thickness and second greater density, and tab portions that provide means for securing the strap to a garment formed from a part of the compressed portion. The core is, preferably, an ester-polyurethane foam, although apparently fiberfill can be used. Also, U.S. Pat. No. 5,240,538 to A. Hyams, et al., titled: Method For Making Padded Straps For Garments, which is a division of the application that resulted into the above patent, is directed to a method of making the padded strap of the above patent.

Other attempts to distribute pressure and therefore ease discomfort include U.S. Pat. No. 4,894,868 to P. E. Christopher, titled: Shoulder Pad Harness, that provides an adjustable narrow band, first and second shoulder straps and first and second shoulder pads, and U.S. Pat. No. 4,612,935 to C. R. Greifer, titled: Comfort Accessories For Brassieres, that is directed to strap adjusting means.

U.S. Pat. No. 4,332,633 to K. Yamauchi, et al., titled: Method For Producing A Shoulder Pad Material, is directed to a method of producing a shoulder pad blank having a thick walled portion and a thin walled portion. It specifically provides for cutting a sheet of shoulder pad stock material sinusoidally into two intermediate blanks each having a plurality of ridges, as well as other features. This patent provides for high production yields by minimizing wasted stock.

Thus, all of these patents fail to provide the strap construction of the present stretch cushion strap assembly. They also appear to fail to use the materials that, in conjunction with this construction, achieve comfort and long wear life coupled with a good appearance.

SUMMARY OF THE INVENTION

Against the foregoing background, it is a primary object of the present invention to provide a stretch cushion strap assembly for a shoulder strap that alleviates discomfort and irritation.

It is another object of the present invention to provide such a stretch cushion strap assembly and resultant shoulder strap that have an attractive, non-bulky outer appearance.

It is still another object of the present invention to provide such a stretch cushion strap assembly and resultant shoulder strap that are free of wrinkles and bunching even after extended use and repeated washings.

It is yet another object of the present invention to provide such a stretch cushion strap assembly that is made of materials and constructed to achieve long wear life.

It is a further object of the present invention to provide such a stretch cushion strap assembly that will be used in the shoulder straps of a brassiere.

It is a still further object of the present invention to provide a method and device for making such a stretch cushion strap assembly.

To the accomplishments of the foregoing objects and advantages, the present invention, in brief summary, comprises a laminated stretch cushion strap assembly having a stretchable cover, a stretchable cushion filler and a stretchable bottom or bottom fabric. The cover includes a stretchable top fabric, a first adhesive web layer positioned on one side of the top fabric and a stretchable base layer positioned on the first adhesive layer on a side opposite that of the top fabric. The stretchable bottom fabric forms with the cover an enclosure. The stretchable cushion filler is adapted to be completely enclosed within the enclosure. The stretchable cushion filler has a first stretchable cushion layer, and adhesive for securing during lamination the cover to the stretchable cushion filler, and the cushion filler to the stretchable bottom fabric. The adhesive is a second adhesive web layer positioned between the stretchable base layer and the first cushion layer to secure the cushion filler to the cover, and a third adhesive web layer positioned on the first cushion layer to secure the bottom fabric to the cushion filler. The components of the cushion strap assembly are laminated together completely by heat and adhesive. The present invention also provides a method and device for making this cushion strap.

BRIEF DESCRIPTION OF THE DRAWINGS

The foregoing and still other objects and advantages of the present invention will be more apparent from the following detailed explanation of the preferred embodiments of the present invention in connection with the accompanying drawings wherein.

BRIEF DESCRIPTION OF THE PREFERRED EMBODIMENTS

Figure 1:
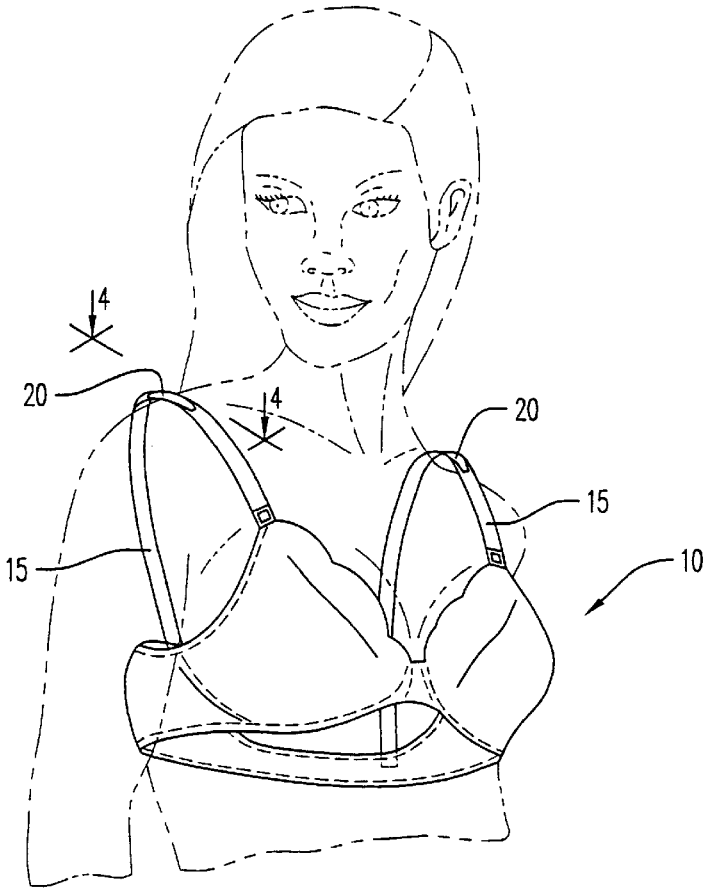
FIG. 1 is a perspective view of a brassiere having a pair of the brassiere straps each incorporating the cushion strap assembly of the present invention.
Figure 2:
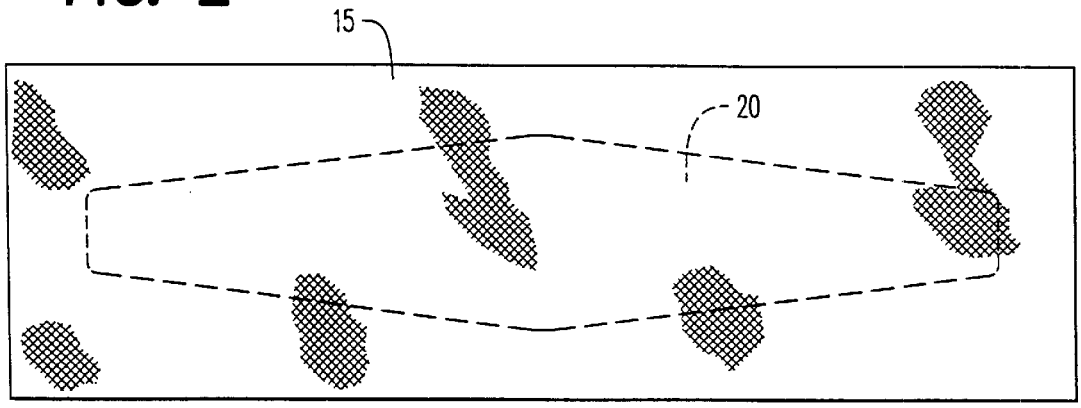
FIG. 2 is a top view of the cushion strap assembly of FIG. 1.

Referring to the figures and, in particular, FIG. 1, there is provided a brassiere generally represented by reference numeral 10. The brassiere 10 includes a pair of shoulder straps 15. Each shoulder strap 15 has, as shown more clearly in outline form in FIG. 2, a stretch or stretchable cushion strap assembly 20 of the present invention.

Figure 3:
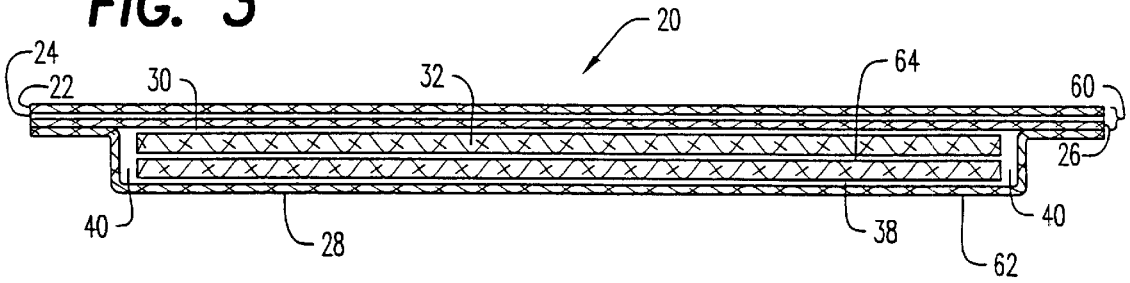
FIG. 3 is a cross-sectional view of the cushion strap assembly of FIG. 1.

Referring to FIG. 3, the cushion strap assembly 20 includes multiple layers of material and adhesive. In a preferred embodiment, the multiple layers are approximately seven layers. These multiple layers can be broken down into three portions, namely a top cover 60, a. bottom cover 62, and a cushion filler 64 that is positioned between the top and bottom covers.

The top cover 60 includes an outer or top fabric layer 22, a first adhesive web layer 24 and a base layer 26. The top fabric layer 22 is a decorative layer that is the top of the brassiere strap, namely the part of the brassiere strap away from the shoulder of the brassiere wearer. The top fabric layer 22 is made of a stretch or stretchable material. Preferably the top fabric layer 22 is made of an elastomeric fabric of nylon (such as Antron nylon) and spandex (such as Lycra spandex) It is believed that equivalent fabrics having similar properties could be used as a top fabric layer 22, instead of the preferred elastomeric fabric The preferred top fabric layer 22 is knitted from two bars (58% and 32%, for 90% total) trilobal Antron nylon and one bar of dull Lycra spandex This fabric weighs approximately 275 g/m$^2$, and has an elongation of about 110 to about 140% in a warp direction and about 50 to about 70% in a weft direction. The preferred top fabric layer, a raschel elastomeric fabric is sold by Warshow. This fabric, as all preferred fabrics selected for use herein, offers superior hand or feel, as well as superior stretch properties for the present objective.

The preferred top layer 22 was selected for its combination of aesthetics and function. This material has the appropriate surface finish to look pleasing, and also has the stretch characteristics required for the strap's function.

The first adhesive web layer 14 is not merely adhesive but is a film or web of adhesive. This film or web of adhesive is desired since it will readily migrate into adjacent layers, such as the top fabric layer 22 and the base layer 26, during the laminating process. In the preferred embodiment, the first adhesive web layer 24 is made of an elastomeric polyurethane nonwoven web 5A )adhesive. Preferably, the adhesive web layer is made of a stretch adhesive sold by Spunfab, Ltd. under the tradename Spunfab PB7435. This stretch adhesive has a melting point from about 228 to about 338° F., a fusing temperature from about 320 to about 340° F., and a tacking temperature from about 304 to about 312° F. This web must not discolor at fusing temperature, or the finished product will not have an attractive appearance. It is primarily composed of a ternary resin system polyurethane with a minor amount of additives. This material can withstand washing and dry cleaning, even when heavier amounts of adhesive are used. A typical fabric adhesive, such as a polyamide web adhesive, has a certain amount of crosswise stretch but little or no stretch in the selvage direction. Thus, the elongation of the stretchable fabric layers would cause shear stress at the glue line, causing the layers to pull apart and delaminate over time in a flexible, stretch strap.

The base layer 26 is a moldable raschel elastomeric fabric made of nylon and spandex, preferably sold by Liberty Fabrics under the trademark Superlook Style No. 7130. This fabric is made from about 85% nylon and about 15% spandex, namely a front bar of 40/13 denier S. D. Antron nylon, a middle bar of 40/13 denier S. D. Antron nylon, and a back bar of 140 denier Lycra spandex. This fabric, as the base layer 26, has been found to have the desired stability during the lamination process, while still providing lengthwise stretch and flexibility to the strap assembly. Basically, it can withstand shrinkage during heating and has a higher melting point than various other synthetic fabrics. The preferred base layer 26 was selected for its combination of cost and function this material does not require a surface finish because it is enclosed in the layered package. This allows a less expensive material to be used. This material does, however, have stretch characteristics that permit the strap to function well.

The bottom cover 62 includes a bottom fabric layer 28. The bottom fabric layer 28 forms the outer or bottom part of the strap that contacts the skin of the brassiere wearer. The bottom fabric layer 28 is preferably made of the same material used for the base layer 26 of the top cover 60, namely a moldable raschel elastomeric fabric, such as Superlook.

The cushion filler 64 preferably consists of a single cushion layer 32. The cushion layer 32 is preferably made of a nylon/spandex stretch fabric that is that is known as Duplex fabric F18-279, sold by Milliken & Company. This new Duplex fabric is a modified version of a non-stretch Duplex fabric, which is the subject of U.S. Pat. No. 4,601,940, to A. W. Fischer, which issued on Jul. 22, 1986. The text of that patent is incorporated herein by reference.

This stretch Duplex fabric is preferred since it has a unique construction that provides both the best performance and profile. Specifically, the yarns in this fabric have been found to stand erect and maintain much of their resiliency even after compression. For this reason, this fabric is preferred over other fabrics.

The thickness of the layer of this fabric should be such that it is not too thick, since the yarns in this fabric have a tendency to lean from their vertical position and, thus, some resiliency may be lost during compression. Conversely, if each layer of this fabric is too thin, it will not have enough fluff to provide optimal cushioning. Accordingly, the layer of this stretch Duplex fabric in the present cushion strap assembly should preferably be about 0.140 to about 0.170 inches in thickness.

The use of only one layer of Duplex fabric is preferred in the present cushion strap assembly since more than one layer did not perform as well as one layer, partly due to the thicker and perhaps bulky appearance provided by more than one layer. Two or more layers can be used, preferably adhered together by an elastomeric copolymeric nonwoven web adhesive such as Spunfab PB7435 stretch adhesive. However, the use of a single layer is preferred.

The preferred stretch Duplex fabric is knitted in a five bar knitting construction, including a first bar of DuPont filament nylon, a second bar of DuPont Lycra spandex, a third bar of monofilament nylon, a fourth bar of DuPont Lycra spandex and a fifth bar of DuPont filament nylon. This results in a fabric of about 89% nylon and about 11% spandex. This fabric has an elongation of about 148 to about 180% in a warp direction, and of about 50 to about 65% in a weft direction. It has also been discovered that the Duplex cushion is preferably cut at about 90° to the selvage of the fabric to prevent the finished cushion from rolling up.

It has been found that fiberfill cannot be used as effectively as a cushion layer since fiberfill is not as stable. Also, foam is not desired as a cushion layer since it would decompose during the heating needed in the process of making the cushion strap assembly. Further, as stated above, foam has poor wear life. This is exacerbated in a stretch strap assembly, as the fiberfill or foam would break down even more quickly when subjected to repeated stretch and release cycles.

A second adhesive web layer 30 is positioned between the top cover 60 or binder layer and the cushion filler 64. Specifically, it is positioned between the base layer 26 and the first cushion layer 32 to secure the top cover 60 and cushion filler 64 together during lamination. The second adhesive layer 30 is preferably made of a substantially non-stretch adhesive web formed of one hundred percent polyamide adhesive which is sold under the tradename Sharnet-SH2410/06. This is the only layer of the shoulder strap construction that is not designed to stretch substantially in a lengthwise direction. However, when the components of the cushion assembly are heated during lamination, the Sharnet adhesive web layer migrates into the adjacent layers to form the laminate, and will not impede the stretching of those layers. This layer is designed primarily to hold the cushion material in place during processing, and may delaminate substantially during use without compromising the performance of the strap assembly.

A third adhesive web layer 38 is positioned between the cushion filler 64 and the bottom fabric layer 28 to secure them together during lamination. Specifically, the third adhesive web layer 38 is positioned between the cushion layer 32 and the bottom fabric layer 28. It is preferably made of the same stretch adhesive as first adhesive web layer 24.

Thus, the cushion strap assembly includes the following layers in sequential order from the top of the brassiere strap: the top fabric layer 22, the first adhesive web layer 24, the base layer 26, the second adhesive web layer 30, the cushion layer 32, the third adhesive web layer 38, and the bottom fabric layer 28.

Figure 4:
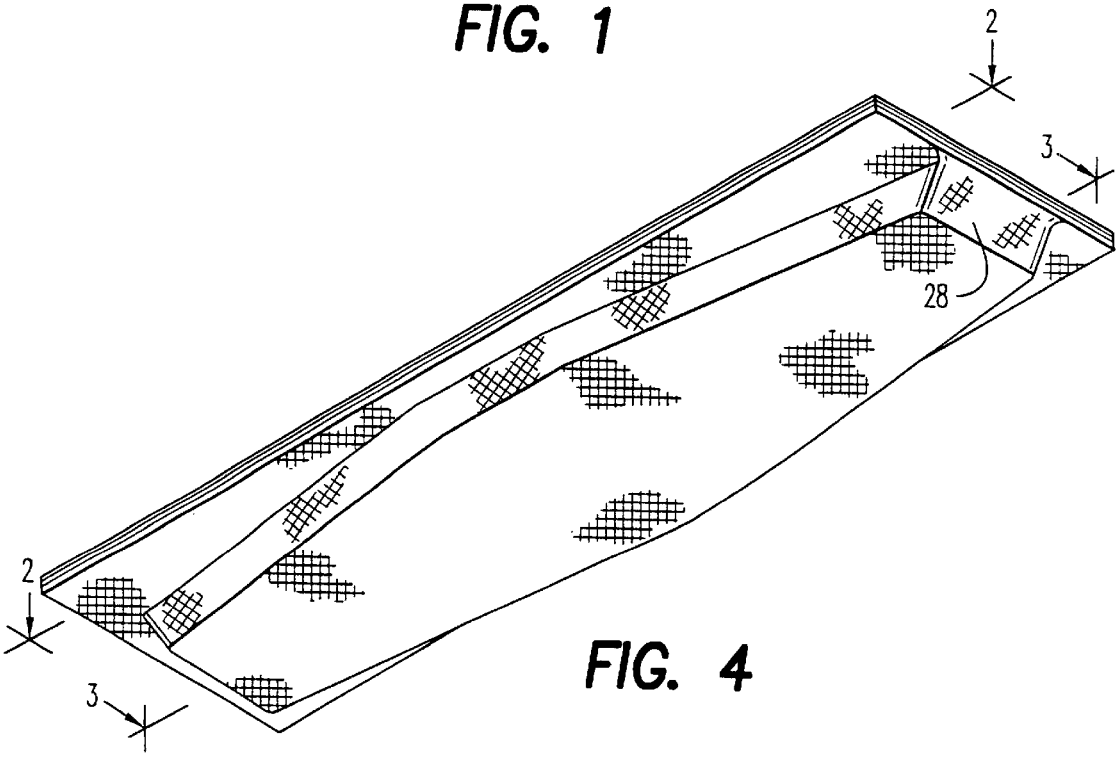
FIG. 4 is a perspective, sectional view taken along lines 4—4 of FIG. 1 illustrating the formed bottom portion of the cushion strap assembly.

The top fabric layer 22, the first adhesive web layer 24 and the base layer 26 form the top cover 60 of the strap, and the bottom fabric layer 28 and adhesive layer 38 form the bottom cover 62 of the strap. These top and bottom covers form an enclosure or enclosed sheath that receives the cushion filler 64. As shown in FIGS. 3 and 4, the bottom fabric layer 28 forms the depth of the enclosure. As shown in FIG. 3, the cushion filler 64 does not contact the ends of the enclosure, but instead there is a space 40 at each end. Thus, the cushion filler 64 would move within the enclosure if it were not for the second and third adhesive web layers 30 and 38 (primarily the latter) that secure the cushion filler 64 into position between the top and bottom covers. The space 40 accommodates some of the stretching of the cushion filler 64 that occurs during the lamination process, as well as during wearing and washing of the shoulder strap. Also, the construction of the cushion filler 64 and the assembly, and the nature of the materials, permits the stretching and twisting that normally occurs during both washing and wearing.

The-formed cushion strap assembly provides a sleek strap having a pleasing aesthetic appearance. It has been found through preliminary tests that this appearance remains after repeated washings. This is apparently due to the materials used and the construction of the cushion strap assembly.

Figure 5:
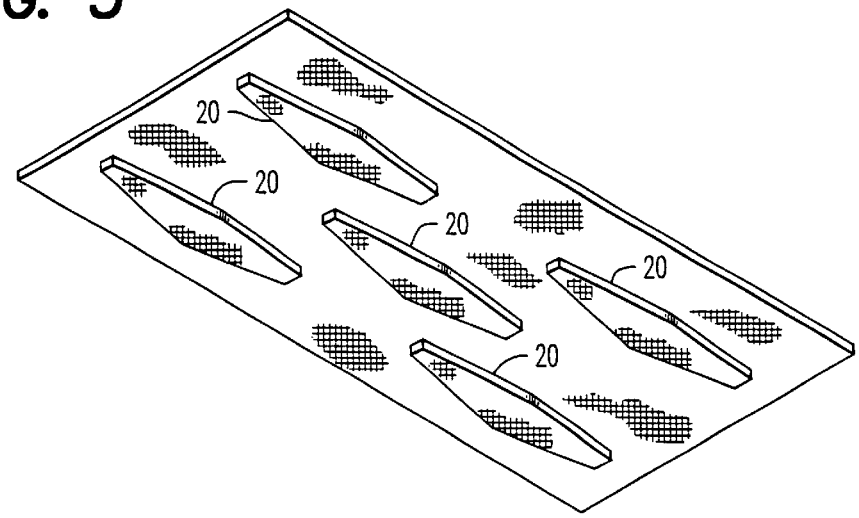
FIG. 5 is a plurality of cushion strap assemblies during the formation process.
Figure 6:
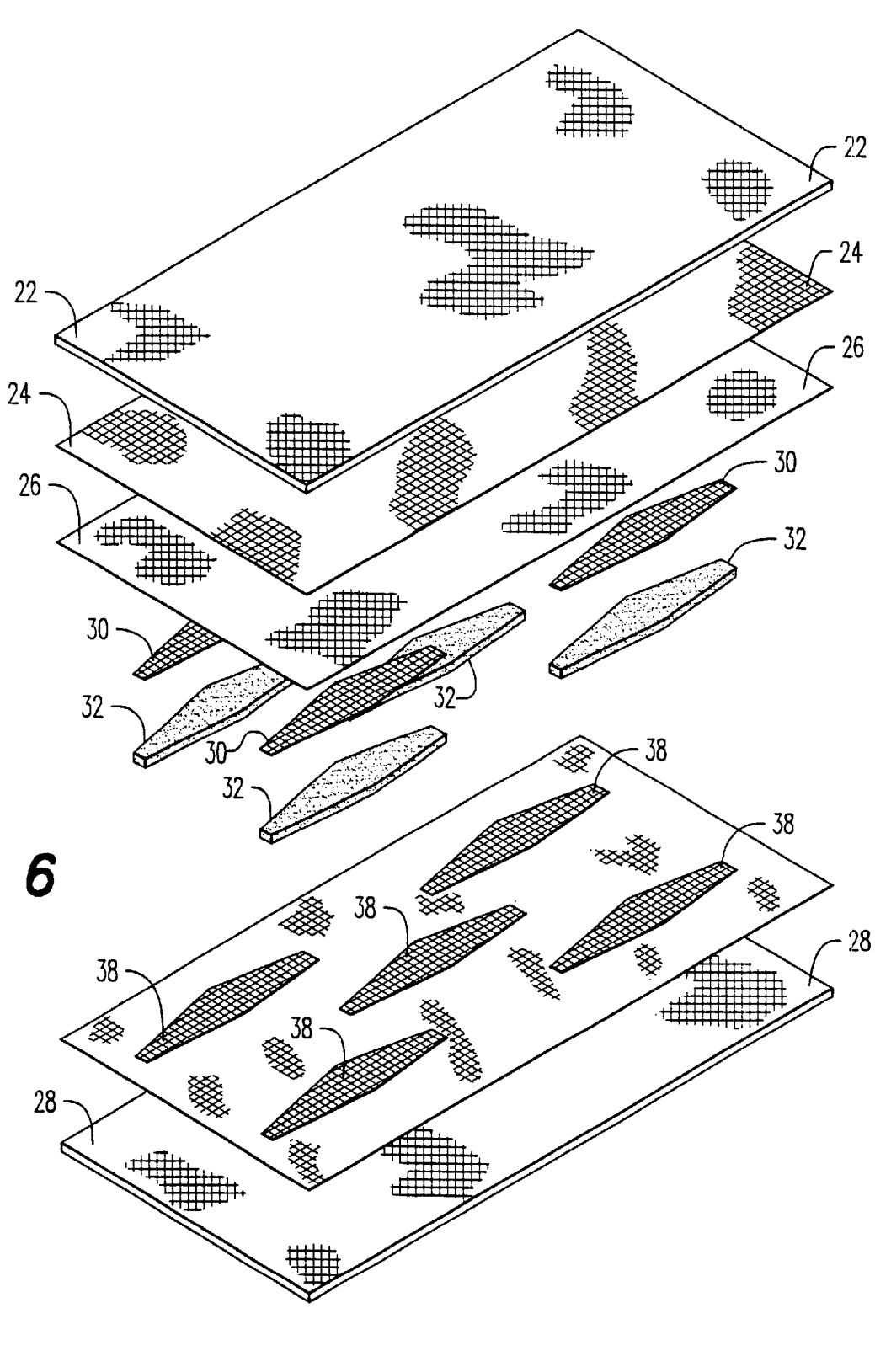
FIG. 6 is an exploded view of the components used to manufacture the plurality of cushion strap assemblies.

Referring to FIGS. 5 and 6, this cushion strap lends itself to the making of several cushion strap assemblies and resultant straps at the same time. First, the top cover 60 is laminated into a binder layer. Specifically, the top fabric layer 22, the first adhesive web layer 24 and the base layer 26 are laminated together to form a binder layer. The components of the cushion filler 64 can optionally separately laminated together.

The cushion filler 64 is then cut to the desired shape, preferably an elongate oval or biscuit-shaped cushion. Multiple cushions are then placed in trays, and fed to an alignment station. The laminated cushions are positioned on the laminated binder layer and second adhesive web layer 30. Third adhesive layer 38 and bottom fabric layer 28 are then placed on top of the cushions, to form the layer structure of the strap. Individual strap assemblies are then molded and laminated together, and cut out, around the cushions.

The cushion filler 64 and the top cover 60 and bottom are not compressed beyond the normal compression associated with lamination. Each component's compression, if any, is the same as that of the other components so that each component is of the same density, thus providing a good profile and appearance.

Figure 7:
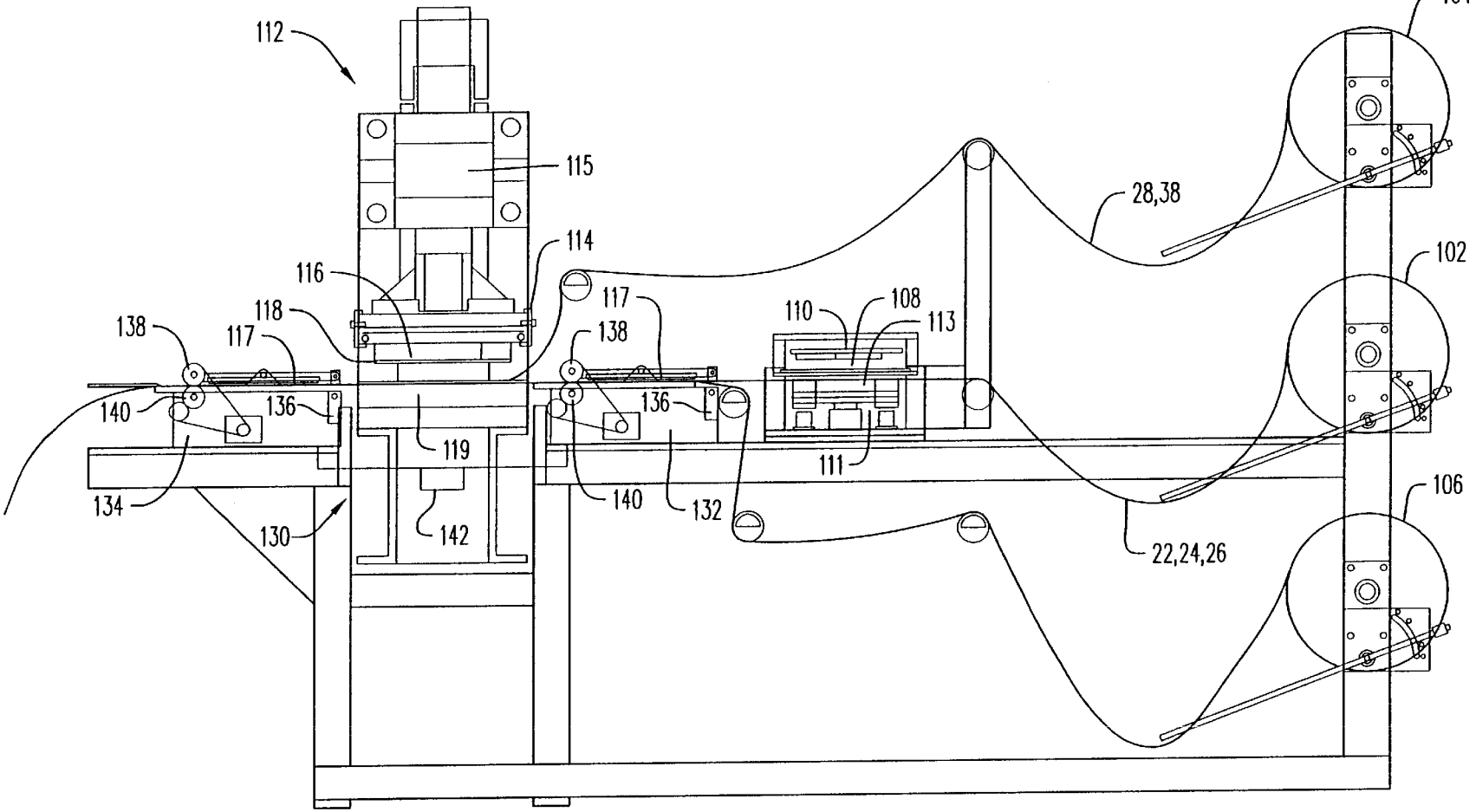
FIG. 7 is a diagram of the device used to make the present cushion strap assembly.

The preferred device and method for forming these shoulder straps can be understood with reference to the preferred device depicted in FIG. 7. The laminated binder layer (the top fabric layer 22, the first adhesive web layer 24 and the base layer 26, laminated together), slit to the proper width, is fed from roll 102. The bottom fabric layer 28 and the third adhesive layer 38 are fed as a web from roll 104. Preferably, a paper web is fed from roll 106. Each layer is automatically unwound with core drive motors within a loop deadband to minimize tension in the webs in subsequent processing. These layers are fed first to cushion loading station 110.

At cushion loading station 110, cushion feeder and ejector 108 places cushions 111 (cushions 111 preferably include second adhesive layer 30) between binder layer (22,24,26) on one side, and third adhesive layer 38 and bottom fabric layer 28, on the other side. The cushions have preferably been loaded into cushion feeder and ejector 108 by hand.

Contemporaneously, binder layer (22,24,26) is heated to process temperature (preferably about 370° F.) by heated platen 113. This causes the cushions 111 to attach to the binder layer. The resulting fabric sandwich is fed to a mold and cut station 112. The mold and cut station 112 is able to mold, laminate, and cut out multiple finished shoulder strap assemblies in a single processing station.

The mold and cut station 112 includes a two-level device 114 mounted on a hydraulically operated ram 115. Two-level device 114 includes outer, upper cutting forged steel die 116 (or dies) and inner, lower aluminum spring-loaded mold (or molds) 118. As device 114 is lowered toward the fabric sandwich, mold 118 contacts the fabric sandwich first. The mold or molds 118 (preferably six or eight) are brought into contact with the fabric sandwich to a precisely-controlled height to provide a process mold pressure of approximately 8 psi by compression of two springs under each mold. Device 114 is stopped for a short period of time (preferably about fifteen seconds), while mold 118 shapes and heats the fabric to laminate the layers and form the strap shape about the cushions. Mold 118 preferably has a cavity therein that is complementary to the shape of the cushion, while the other mating surfaces of this station are flat. A standard cartridge resistance heater is preferably adjoined to the cavity to heat it to molding temperature (preferably about 360° F.). In addition, mold and cut station 112 preferably includes a heated cutting plate 119 (preferably about 290° F.).

After a short delay, die or dies 116 lowers about mold 118 until it contacts and perforates the fabric sandwich. The ram 115 is moved to an adjustable hard limit which allows the strap assembly to be cut from the web by the dies 116. Preferably, die 116 is dulled at two or more places, such as at two opposing ends, to leave two points of attachment between the shoulder strap assembly and the scrap fabric. This allows the sandwich to be drawn downstream to a subsequent station, where the strap assemblies can be removed from the scrap fabric with light pressure, preferably by hand. The kraft paper web from roll 106 is provided to compensate for uneven cutting height of the dies 118.

This mold and cut station 112, being a single station, provides enhanced fabric alignment and processing in less space. In a machine having separate molding and cutting stations, the heat of molding can cause the materials to shrink. Different materials shrink differently when exposed to heat, and even different lots or batches of the same type of material can respond differently to high temperatures. Thus, the heat of the molding process can cause misalignment between the layers, rendering the finished product commercially unacceptable. The additional step of transferring the molded fabric to the cutting station increases the opportunity for misalignment and inaccurate molding, and subsequent cutting, of the cushion. The present invention addresses these problems, by consolidating the molding and cutting operations into a single station.

The preferred temperature for use in the molding operation of the mold and cut station 112 is about. 340° F. to about 380° F. Most preferred is a temperature of about 360° F. Heated cutting plate 119 is preferably operated at about 280° F. In addition, at these preferred conditions, the cushions are ideally molded for a dwell time from about 12 to about 18 seconds, with about 15 seconds being most preferred.

A fabric sandwich is typically fed through a machine such as, for example, by a single set of clamps at the downstream end of the material. These clamps are typically part of an automatic feed station at which the proper length of material will be pulled through the machine at each stage. This station draws the strap material a preset distance at each machine cycle to maintain the proper component alignment.

However, when using fabrics that stretch in the machine direction, like those of the present invention, a single set of clamps at the downstream end of the fabric pathway is not effective. These clamps would cause the fabric to stretch, and the alignment of the layers would fail. Accordingly, the present invention includes an improved drive system to move the fabric sandwich of the present invention through the processing stations.

This drive system, a geared dual roller arrangement, is used to eliminate shear in the fabric sandwich by driving top and bottom rollers at the same speed and distance. The web is accelerated, driven at constant velocity, and decelerated by a move command generated by the programmable logic controller 142. This trapezoidal move profile minimizes "shock" (affecting stretch) to the web, and is adjustable to compensate for variation in material, especially elongation in a warp direction. The preferred ratio of output feed length to input feed length is about 1 to about 1.05, depending on the controlled amount of tension required to process the web. The trapezoidal move profile is also scaled accordingly.

As shown in. FIG. 7, drive system 130 includes first drive 132, located upstream of mold and cut station 112, and second drive 134, located downstream of mold and cut station 112. First drive 132 and second drive 134 both include a servo motor 136 belt driving a geared knurled nip roller 138 seated above the fabric sandwich. Another driven nip roller 140 is mounted directly below and synchronized with each driven nip roller 138, and the fabric sandwich passes between pair of nip rollers. The upper and lower nip rollers have a slight knurl to drive materials without slippage, but to avoid'picking' the materials with an overly aggressive knurled surface.

Servo motors 136 are synchronized together so that driven nip rollers 138, 140 on infeed and outfeed are rotated equally and at the same time. This moves the fabric sandwich evenly, without stretching or with a small, controlled amount of tension, through mold and cut station 112. This drive system ensures optimal results and a minimum number of rejects due to misalignment, stretching or buckling of layers in the finished strap assembly. The preferred nip roll force is about 55 pounds, or about 7 psi, over the typical eight inch width of the fabric sandwich. In addition, it is preferred what guides 117 are located around the mold and cut station 112 to keep the cushions 111 centered with respect to die 116.

Furthermore, drive system 130 can be designed to allow automatic adjustment of web feed length on each cycle to compensate for material shrinkage or elongation. This active positioning reduces material-related defects, and is preferably accomplished by the addition of photoelectric sensors (not shown) within drive system 130 to detect reference marks on the web. Programmable logic controller 142 can use the detected information to adjust drive feed length while maintaining the preferred output feed length/input feed length ratios.

Having thus described the present invention with particular references to the preferred forms thereof, it will be obvious that various changes and modifications may be made therein without departing from the spirit and scope of the present invention as defined by the appended claims.

What is claimed is:

1. A device for manufacturing a strap assembly comprising a mold and cut station having a lower mold and an upper cutter for molding and cutting the strap assembly at a single location along a continuous web, wherein the lower mold contacts, heats and laminates the strap assembly before the cutter contacts and cuts the strap assembly at the single location.

2. A device for manufacturing a strap assembly comprising:

a mold and cut station having a lower mold and an upper cutter for molding and thereafter cutting the strap assembly at a single location along a continuous web; and a first drive and a second drive located on opposite sides of the mold and cut station for moving the web assembly through the mold and cut station.

3. A device for manufacturing a strap assembly comprising:

a mold and cut station for molding and thereafter cutting the strap assembly at a single location along a continuous web; and a first drive and a second drive located on opposite sides of the mold and cut station, wherein the first drive is synchronized with the second drive to move the web assembly through the mold and cut station under minimal shear.

4. The device of claim 1, wherein the lower mold and upper cutter of the mold and cut station are one component.

* * * * *